US005791172A

United States Patent [19]

Deighton et al.

[11] Patent Number: 5,791,172

[45] Date of Patent: Aug. 11, 1998

[54] ELECTRONICALLY CONTROLLED SECURITY CONTAINER FOR RETAINING DOOR KEY

[75] Inventors: Kevin Deighton, Long Beach, Calif.; Bill Kiss, Ottawa; Graham Neathway, Ontario, both of Canada

[73] Assignee: Multacc Corporation, Torrance, Calif.

[21] Appl. No.: 717,111

[22] Filed: Sep. 20, 1996

[51] Int. Cl.[6] ..... B65D 55/14

[52] U.S. Cl. ..... 70/63; 340/825.31; 292/201; 292/199; 70/278

[58] Field of Search ..... 70/63, 277, 278; 292/182, 229, 199, 201; 340/825.31

[56] References Cited

U.S. PATENT DOCUMENTS

| | | | |
|---|---|---|---|
| 1,955,809 | 4/1934 | Hobbs | 109/50 |
| 3,695,067 | 10/1972 | Bays | 70/63 |
| 3,901,057 | 8/1975 | Coley, Sr. | 70/277 |
| 4,641,505 | 2/1987 | Maurice | 70/63 |
| 4,727,368 | 2/1988 | Larson et al. . | |
| 4,838,052 | 6/1989 | Williams et al. | 70/63 |
| 4,914,732 | 4/1990 | Henderson et al. | 70/63 |
| 5,046,339 | 9/1991 | Krell | 70/63 |
| 5,090,222 | 2/1992 | Imran | 70/63 |
| 5,280,518 | 1/1994 | Danler et al. | 379/100 |
| 5,460,020 | 10/1995 | Hungerford | 70/63 |

OTHER PUBLICATIONS

Supragram Advertisement Summer 1987.

*Primary Examiner*—Darnell M. Boucher
*Attorney, Agent, or Firm*—Edward A. Sokolski

[57] ABSTRACT

A door key is held in a tray which is slidably installed in a container. The tray is retained in the container by a form member pivotally mounted on the container which engages a latch on the tray. A shackle is removably attached to the container for use in retaining the container to a door knob or the like. The shackle has a notched arm which engages a fork member pivotally mounted on the container, thereby retaining the shackle in a closed position. A motor which rotatably drives a drive gear is mounted in the container. When the motor is driven in a first direction, the drive gear drives a tapered release wheel which operates to release the fork member from engagement with the key tray latch, thereby permitting the key tray to be removed. When the motor is driven in an opposite direction, the drive gear drives a second tapered release wheel so as to disengage the notched arm of the shackle from its associated fork member, thereby permitting the shackle to be moved to an open position. The operation of the motor is controlled by an electronic system which employs an infrared control signal.

9 Claims, 7 Drawing Sheets

ELECTRONICALLY CONTROLLED SECURITY CONTAINER FOR RETAINING DOOR KEY

BACKGROUND OF THE INVENTION

1. Field of the Invention

This invention relates to security boxes for retaining door keys and more particularly to such a box which is electronically controlled.

2. Description of the Related Art

A device for retaining a door key in a security container or safe which is attached to the door to be opened is described in U.S. Pat. No. 3,934,434 issued Jan. 27, 1976 to Larson et al. Such devices are particularly useful in situations where ready access must be provided to realtors in the sale of property without compromising security. The aforementioned '434 patent is directed to an electronic control system employing an electronic key in the general form of a "key" card used by the operator for obtaining access to the lockbox. There is no a mechanical mechanism employed within the box for achieving this end result as in the present invention.

BRIEF SUMMARY OF THE INVENTION

The system of the present invention operates in response to an electronically controlled infrared signal which with the proper coded input causes a motor to drive a gear train in one direction or the opposite direction. The key to the door to be opened is contained within a tray which is installed in a container. A latch on the tray is engaged by a fork member pivotally mounted on the container chassis to retain the tray within the container against the action of a spring which urges the fork member in a direction for disengagement. The fork member is held in the engaged position against the spring action by means of a cam attached thereto which engages a tapered threaded wheel. The tapered wheel is connected to the motor gear train. When the gear train is driven in a first direction, the cam is driven along the tapered wheel and finally off the end thereof, releasing the cam from the wheel and permitting the spring to drive the fork out of engagement with the latch, thereby releasing the tray for removal from the container.

A shackle is removably attached to the container and is used to attach the container to a door knob for retention thereon. The shackle has a notched arm which engages a fork member pivotally mounted on the container chassis. In similar fashion to the fork member for the tray, the shackle fork member is spring urged in a direction for disengagement but is retained in engagement by a cam which engages a second tapered wheel connected to the motor gear train. When the motor is driven in a direction opposite to the first direction, the cam is driven along the wheel and finally off the end thereof, permitting the fork to be driven out of engagement with the shackle arm, thereby releasing the shackle.

The operation of the motor is controlled by coded infrared signals which are received by a microprocessor within the container, utilizing circuitry well known in the art.

It is therefore an object of the invention to provide ready access to a house key to authorized persons while affording security against unauthorized access to such key.

It is a further object of the invention to provide an improved mechanism for opening and closing a security key container and attaching and releasing such a container to and from a door knob or the like.

Other objects of the invention will become apparent in connection with the following description in conjunction with the accompanying drawings.

DETAILED DESCRIPTION OF THE INVENTION

Figures 1, 2:
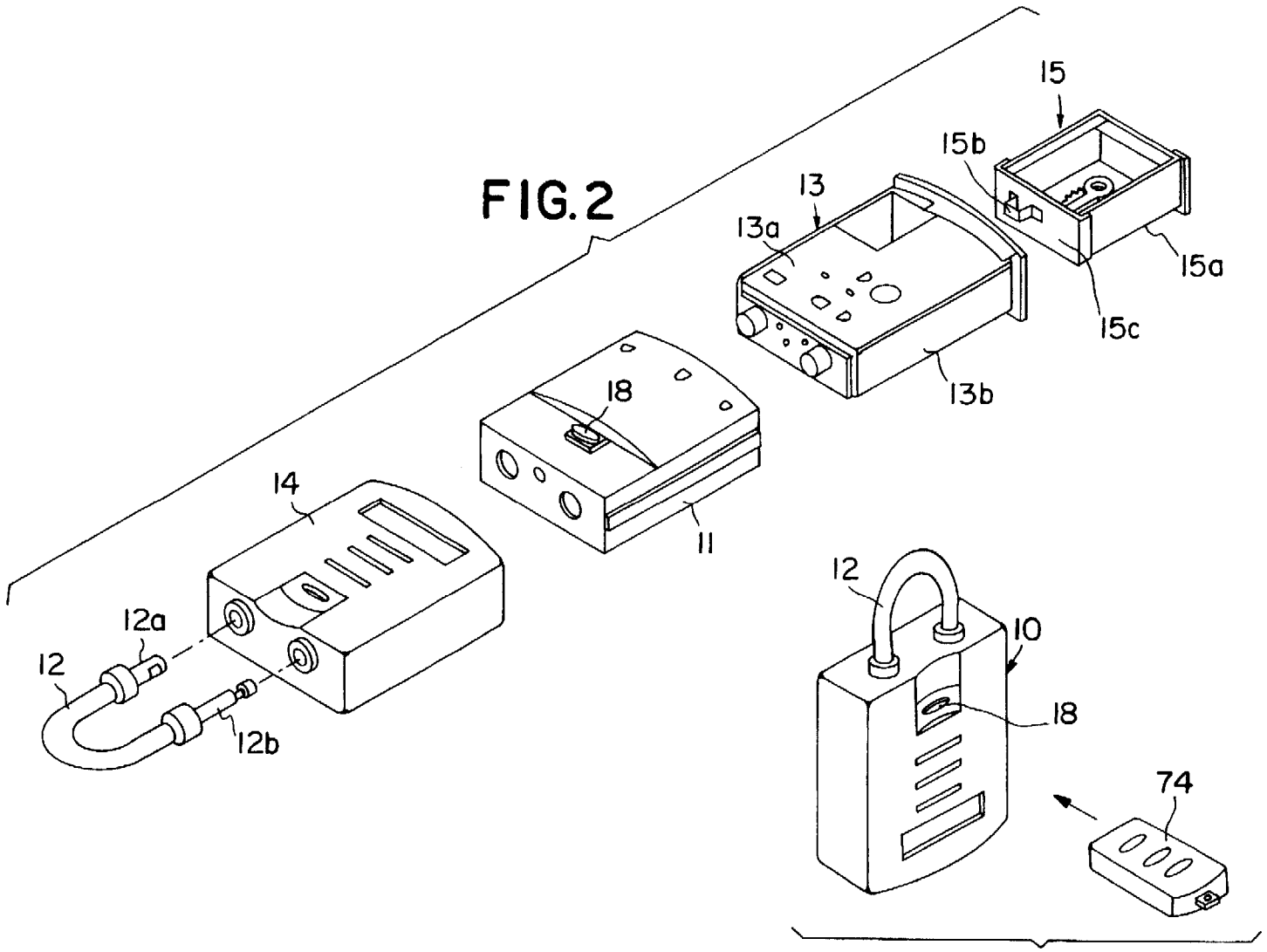
FIG. 1 is a side elevational view of a preferred embodiment of the invention.
FIG. 2 is an exploded view of the receiver unit of the preferred embodiment.
Figure 3:
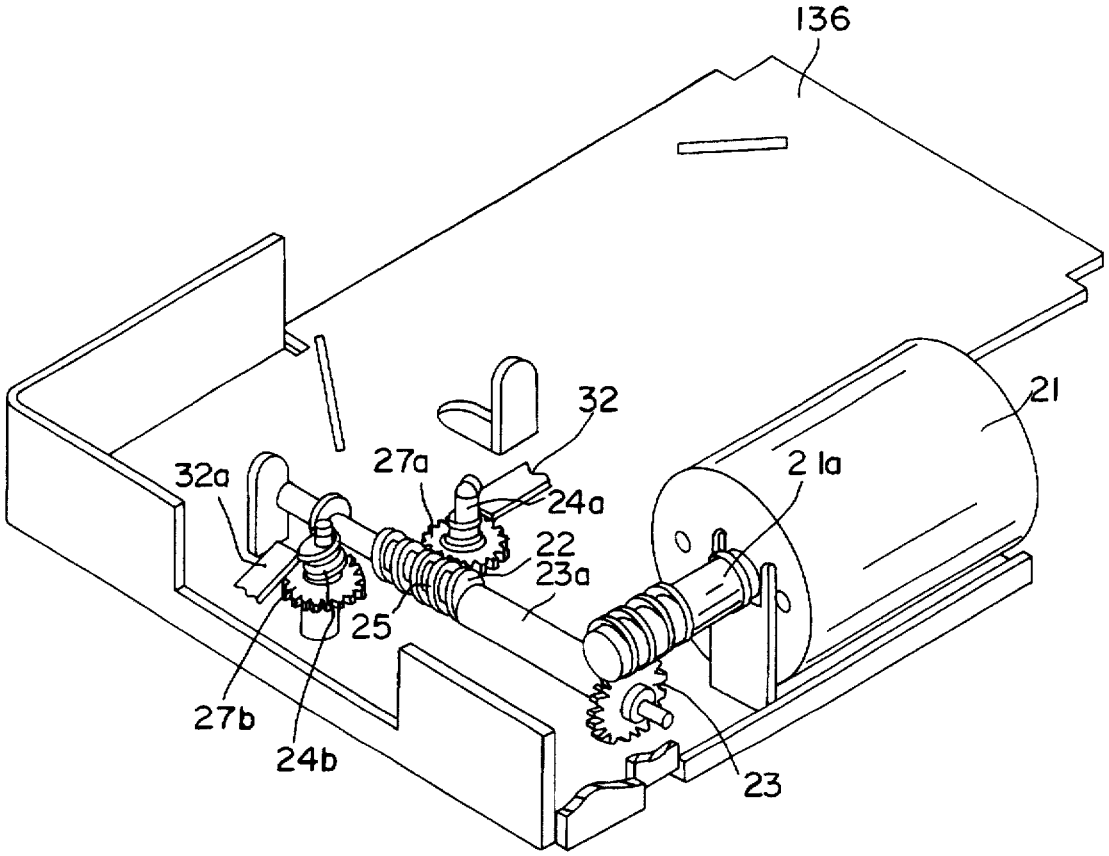
FIG. 3 is a top perspective view of the motor drive mechanism of the preferred embodiment.

Referring to FIGS. 1 and 2, the receiving and operating unit of the preferred embodiment of the invention is shown.

As shown in FIG. 1, the operating unit 10 is housed in a rectangular container and has a shackle 12 extending from the top thereof. FIG. 2 is an exploded view of this unit. Case 11 may be of stamped steel construction and slides over chassis unit 13 which is formed from upper and lower chassis halves **13*a* and 13*b* which are secured together by suitable means such as rivets. An elastomeric cover 14 is slided over case 11 to minimize damage to door knobs or other members to which the unit may be attached. A shackle 12 made preferably of hardened steel for use in retaining the unit to a door knob or the like is removably attached to chassis 13, as to be explained further on in the specification. Shackle 12 has an elastomeric coating over its U-shaped portion to avoid damage to door knobs or other devices it may contact. The shackle has a shorter arm 12*a* and a longer arm 12*b*. Arm 12*a* has a notch formed therein which, as to be explained further on in the specification, engages a fork member which latches the shackle to the chassis. Arm 12*b*** operates in conjunction with a spring catch to retain the shackle to the chassis. The shackle can be completely removed from the chassis by rotating it 180 degrees which releases the spring catch.

Key tray 15, which contains the property key 17, is preferably a stamped steel box. An additional piece of thick gauge steel is spot welded to the base of the tray to guard against attempts to pry the tray open. A latch member **15*b* is welded to the top wall of the tray which operates in conjunction with a pivotal fork member to latch the tray to the chassis, as to be explained further on in the specification. The sides of top wall 15*c* of the tray engage the rear edges of lower tray halve 13*b*, preventing the tray from being fully withdrawn from the chassis or accidentally falling out of the chassis. Lens 18 is mounted on case 11 to focus infrared control signals onto a phototransistor on a circuit board(not shown) mounted on chassis 13**.

Referring now to FIGS. 3, 4A–4D, 5A–5D and 6A,6B, the operation of the device of the invention is illustrated. Electric motor 21 is powered by a battery and has a worm gear drive shaft 21*a* which rotatably drives shaft 22 through drive gear 23 which has an extension sleeve 23*a* therewith. Shaft 22 has a shuttle gear 25 formed thereon which engages either gear 27*a* or 27*b* depending on the direction of rotation. Gears 27*a* and 27*b* are integrally formed with tapered geared wheels 24*a* and 24*b* respectively.

Figure 6A:
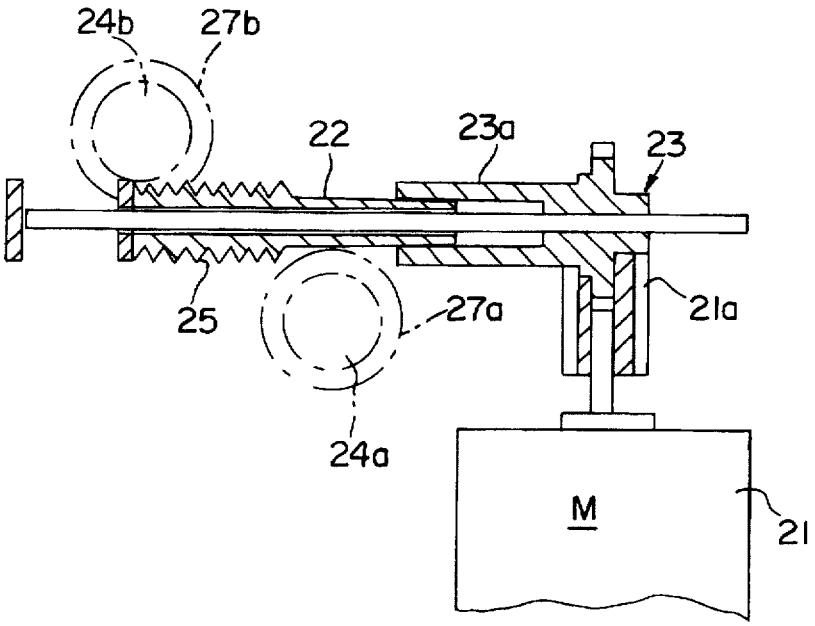
FIGS. 6A and 6B are schematic illustrations showing details of the gear drive mechanism of the preferred embodiment.
Figure 6B:
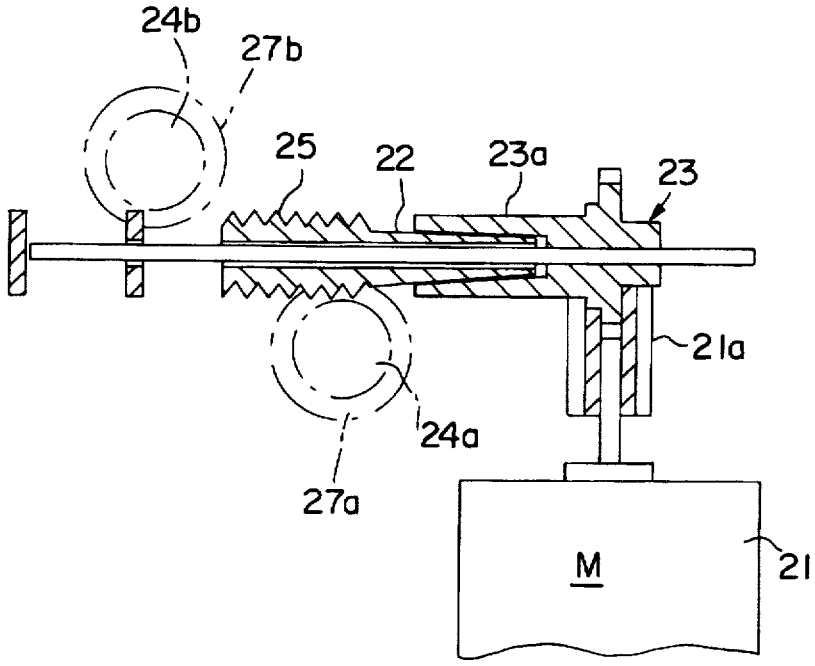

Referring now to FIGS. 6A and 6B, the operation of the drive mechanism to engage gear 27*a* when the shaft is rotated in one direction to engage gear 27*b* when the shaft is rotated in an opposite direction is schematically illustrated. Drive gear 23 has an extension piece 23*a* fixed attached thereto which has a square bore which abuts against the flat faces of shuttle gear shaft 22. Thus, the shuttle gear 25, while it rotates with drive 23 is free to move longitudinally relative thereto. Thus, when the direction of the motor is reversed, the shuttle gear will move longitudinally from its position in engagement with wheel 24*b*, as shown in FIG. 6A to a position in engagement with wheel 24*a* as shown in FIG. 6B and vice versa.

Figure 4A:
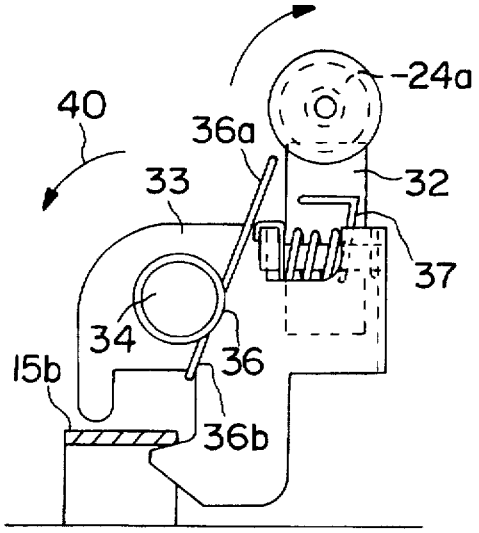
FIGS. 4A–4D are a series of schematic views illustrating the operation of the key tray latching mechanism of the preferred embodiment.
Figure 4B:
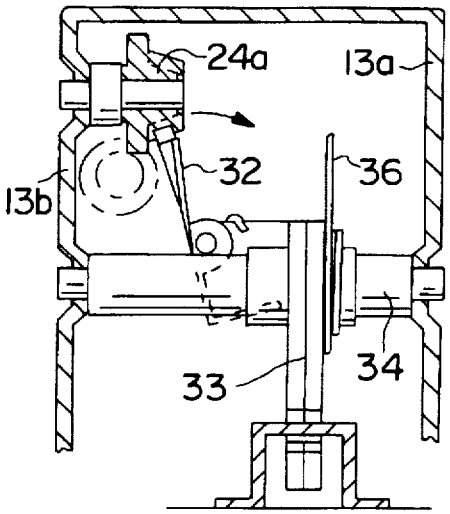
Figure 4C:
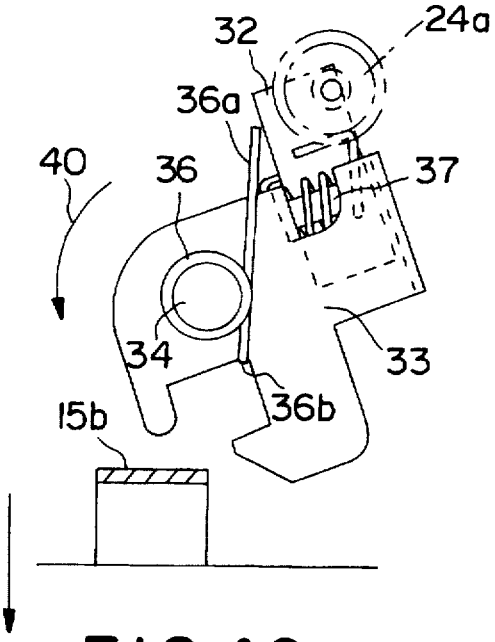
Figure 4D:
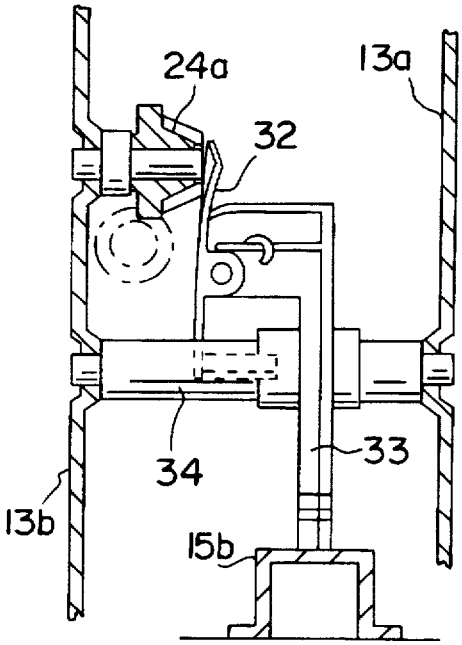

Referring now to FIGS. 4A–4D, the operation of the tray latching and release mechanism is illustrated. When the tray is latched to retain the tray in the container, as shown in FIGS. 4A and 4B, threaded tapered wheel 24*a* is engaged by the end portion of cam 32. Cam 32 is spring loaded by spring 37 so as to urge the cam towards the tapered end of the wheel. Fork member 33 is fixedly attached to pivot pin 34 which is pivotally supported between the upper and lower chassis portions 13*a* and 13*b*. Fork member engages key tray latch 15*b* to retain the key tray in the container when cam 32 is in engagement with wheel 24*a*. Fork member 33 is spring loaded in the direction indicated by arrow 40 by spring 36. Spring 36 is installed on pin 34 with one end thereof 36*a* abutting against chassis portion 13*a* and the other end thereof 36*b* hooked onto fork member 33.

As wheel 24*a* rotates, cam 32 moves along the wheel thread until it finally drops off the end of the wheel. When this occurs, the fork rotates to the position indicated in FIGS. 4C and 4D in response to the bias force of spring 36, thereby disengaging tray latch 15*b* and releasing the tray.

To re latch the key tray mechanism, the tray is pushed all the way back into the housing and released. As the key tray moves back into the container its roof engages the lower edge of the fork causing it to rotate in a clockwise manner. As the fork rotates, the cam 32 engages the edge of wheel 24*a* and pivots towards the fork allowing the cam to slide past the front face of the wheel. Once the lower edge of the cam has crossed the front face of the wheel, the cam is pushed away from the fork by the spring 37, dropping the lower edge of the cam back into the start of the thread, as shown in FIG. 4B.

Figure 5A:
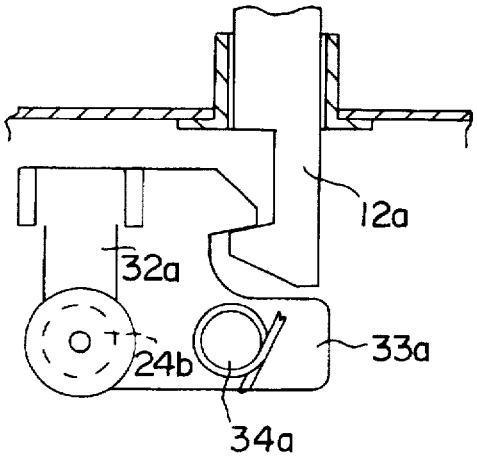
FIGS. 5A–5D are a series of schematic views illustrating the operation of the shackle latching mechanism of the preferred embodiment.
Figure 5B:
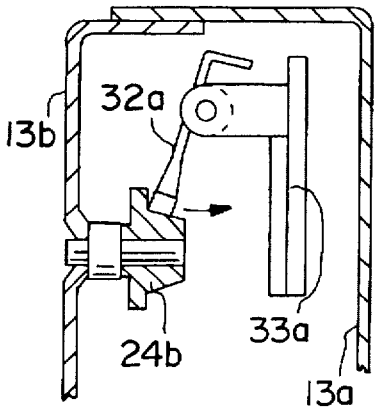
Figure 5C:
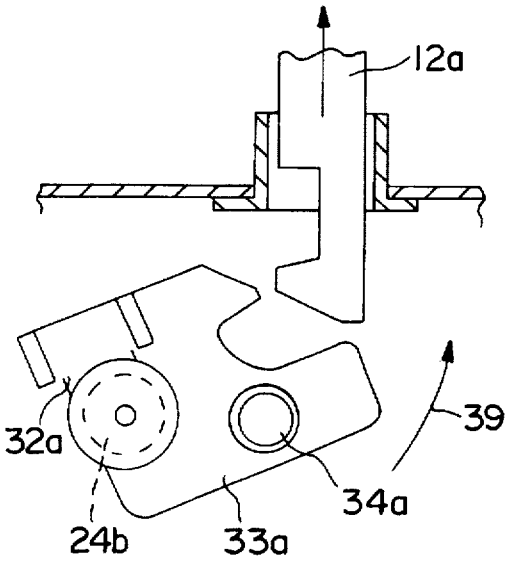
Figure 5D:
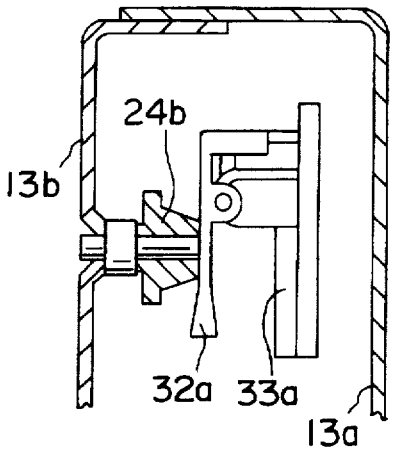

Referring now to FIGS. 5A–5D, the operation of mechanism for latching the shackle arm in place is schematically illustrated. This mechanism is the same as that just described in connection with FIGS. 4A–4D and operates in the same fashion. Thus, cam 32*a* engages the gear teeth of wheel 24*b* against spring bias which urges the cam towards the tapered end of the wheel. With the cam engaging the wheel,as shown in FIGS. 5A and 5B, fork 33*a* which is pivotally supported on the chassis by pivot pin 34a engages the notched portion of shackle arm 12*a*, retaining the shackle to the container. When the cam 32*a* rides off the end of wheel 24*b*, a spring drives the fork in the direction indicated by arrow 39 to disengage the fork from arm 12*a*, as shown in FIGS. 5C and 5D. The shackle is reinstalled in the container by pushing arm 12*a* against the fork, rotating the fork clockwise until it reengages arm 12*a* and cam 32*a* rides back onto the teeth of wheel 24*b*.

Figure 8:
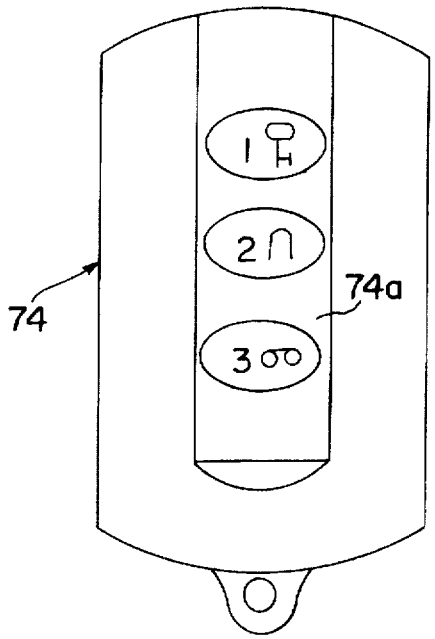
FIG. 8 is an elevational view of the hand operated access control of the preferred embodiment.

Referring now to FIG. 8, an access control unit 74 which may be utilized to operate the device of the invention is illustrated. Within this unit a printed circuit is contained which has a photo transceiver and transmitter attached thereto. This unit also contains a battery for operating the circuitry and a piezo speaker for generating a sound signal. A lens is provided to focus the infrared control signal generated. The unit has a keypad 74*a* for use by the operator in entering control signals. The keypad has three buttons, each having a numeral, 1, 2, or 3 and an icon representing either a key, shackle or reading glasses which can be actuated to release the key tray, release the shackle or to read the memory of the receiver respectively. The access control device, as already noted, contains a piezo horn which provides an audible response to the user indicating data entry. As each button is pressed, the horn emits a short beep to inform the user that a correct button actuation has occurred. A series of six short beeps indicates that the device cannot be operated for such reasons as the entry of an incorrect personal identification number, an attempt is being made to enter after the programmed hours of operation, the tamper lockup mode has been operated, or some other improper situation exists. A longer beep confirms that the unit has communicated successfully.

Figure 9:
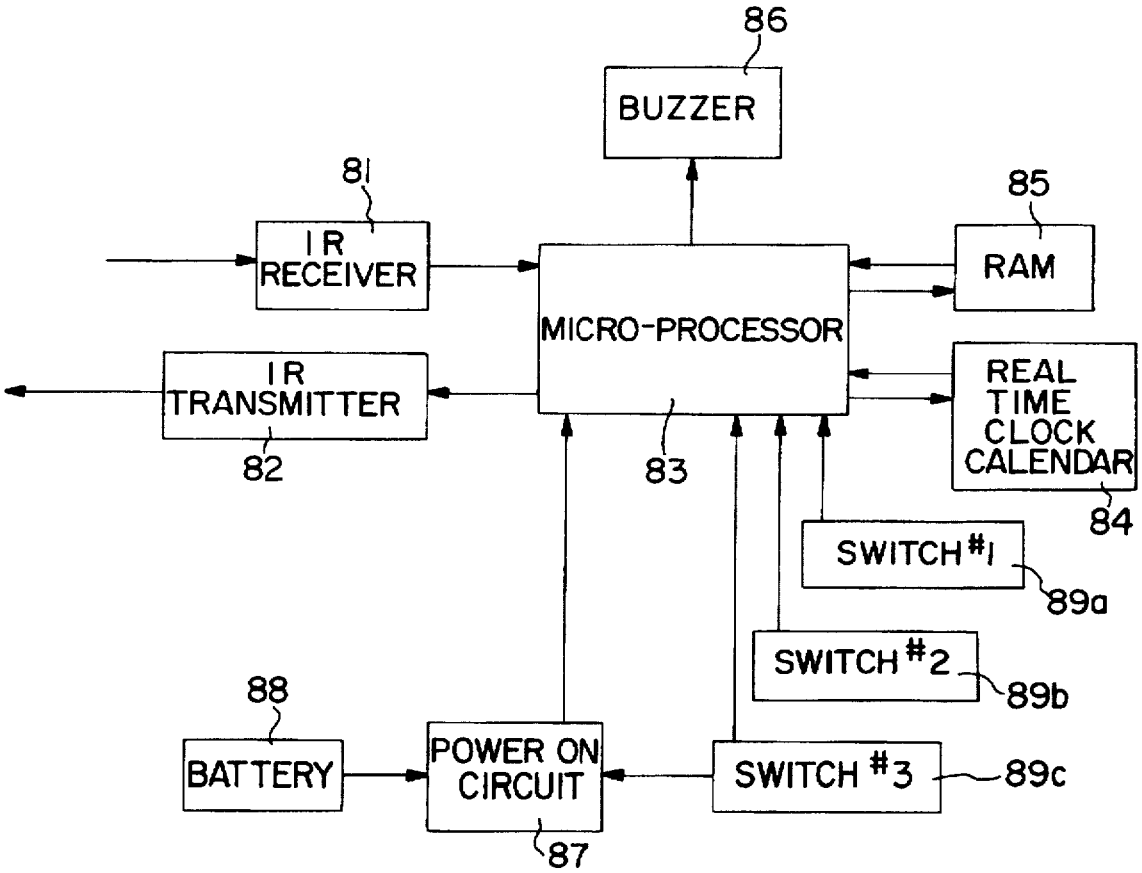
FIG. 9 is a functional block diagram of the access control circuitry of the preferred embodiment.

Referring now to FIG. 9, the circuitry of the access control device is illustrated in functional block form. It is to be noted that the basic circuitry involved is well known in the art and is commercially available. The circuitry can be readily programmed by one of ordinary skill in the art to perform the desired operation. Infrared photo transmitter 82 transmits the signals generated by the access device to lens 18 mounted in the operating unit 10. Microprocessor 83, which may comprise a Motorola model 68HCO5P6 processor, is programmed to control the access device, as indicated above, according to the firmware stored in its read only memory. Real time clock calendar 84 provides data as to the date and time to the microprocessor. Read/write RAM 85 is used to record the data from previous transactions. Buzzer unit 86 generates audible signals indicating various operating conditions, as indicated above.

The access control device is energized by depressing button "13" (see FIG. 8) which activates switch 89*c*. This switches on Power on circuit 87 connecting battery 88 to the microprocessor 82. The microprocessor is activated and reads the current time and date from clock-calendar 84. If the expiration date has not been reached and the time is not within the night lockout times, the unit will prepare to receive function selection instructions. The desired function is selected by pressing the button having the icon representing this function(see FIG. 8). This selection must be made within seven seconds of the "power-on" signal or the power-on signal will be treated as a mistake. The operator next enters his or her four digit PIN number on the access control unit buttons (FIG. 8). This PIN number is entered into the microprocessor through switches 89*a*, 89*b*, and 89*c*. This entered number is compared with the PIN stored in the read only member of the microprocessor. If the correct number has been entered, a control signal is transmitted to the operating unit 10 to effect the desired operation. It is to be noted that in the event a number of incorrect PIN codes (e.g. five such incorrect codes) a control signal is generated which prevents the device from operating until a special "tamper reset code" is entered into the unit. It is to be noted that this and other external signals may be entered into the microprocessor through infrared receiver 81.

Figure 7:
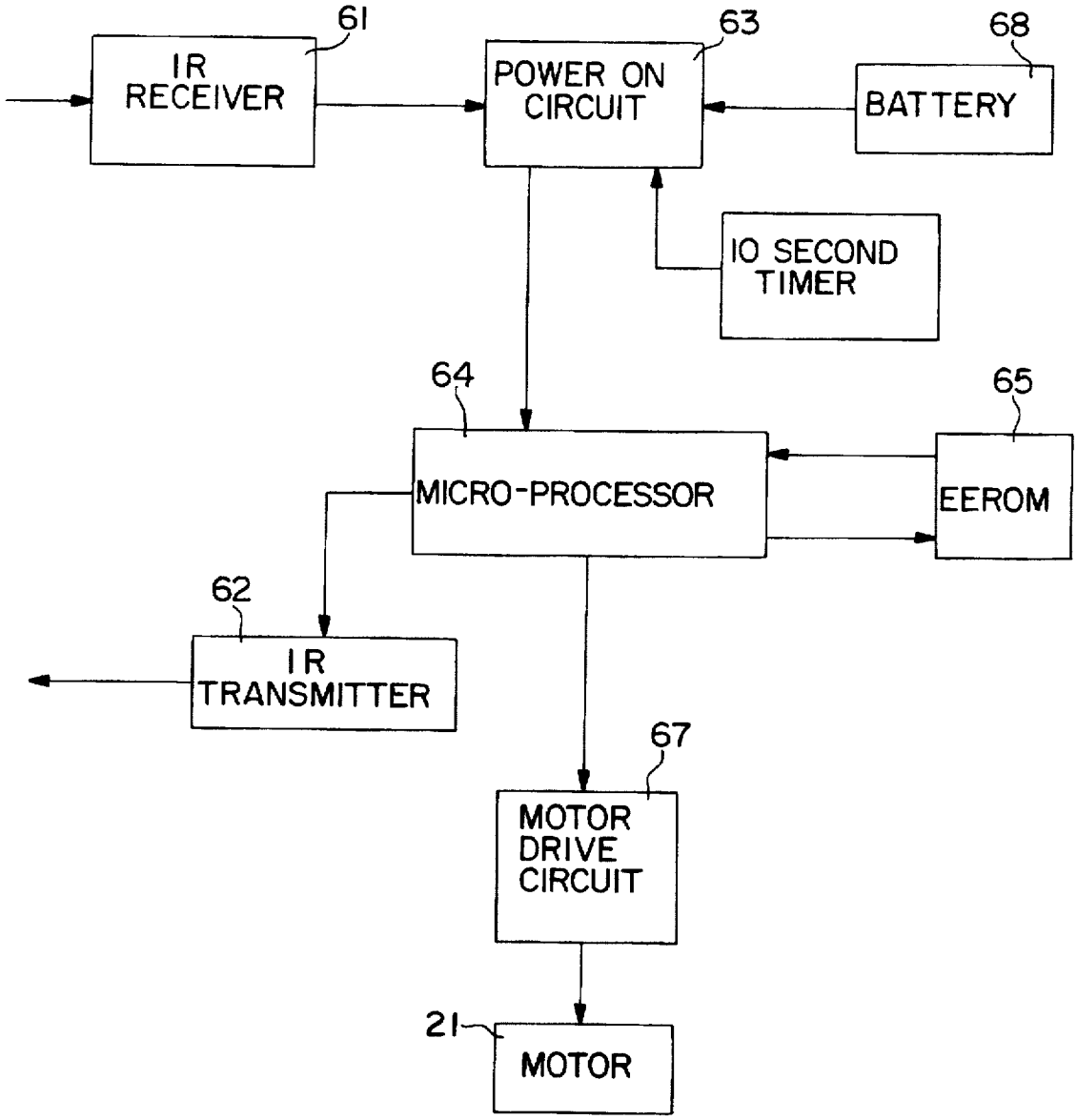
FIG. 7 is a functional block diagram showing the circuitry of the control system of the preferred embodiment.

Referring now to FIG. 7, a functional block diagram of the electronic circuitry of the control or operating unit is shown.

An infrared receiver 61 and an infrared transmitter 62 are provided to receive and transmit infrared control signals. Receiver 61 receives control signals from the transmitter 82 of the access control device, these signals passing through lens 18(see FIG. 1). To prevent activation by ambient sunlight or artificial light, the received signal is passed through a filter circuit which filters out such unwanted signals. When a "power on" control signal is received from the access control device, power on circuit 63 is activated to connected power from battery 68 to microprocessor 64. Microprocessor may the same type of unit as that used in the access control circuitry. A "wake up" circuit in the microprocessor determines whether the input signal is from an access control or a programming interface device and once determined that such is the case the data stream is fed to the microprocessor. Such data stream would include information as to the access device owner, the time and date of the transaction and the type of transaction(i.e. tray release, shackle release, or reading of the microprocessor memory). Information as to the access device owner is loaded into EEROM memory 65.

If the desired function is to release the shackle, the microprocessor reads the shackle code received and compares this with the code stored in the read only memory of the microprocessor. If the code is found to be correct, a control signal is sent to motor drive circuit to cause this circuit to feed power from the motor battery in a polarity to effect counterclockwise rotation of the motor. This power is fed for a predetermined period of time sufficient to effect the release of the shackle as previously described. In the event that a signal is received to release the key tray, the microprocessor provides a signal to the motor drive circuit 67 to effect clockwise rotation of the motor for a predetermined prescribed period to effect release of the tray, as previously described. If the code stored in the microprocessor does not match with the code of the input signal, a denial signal is generated prompting the generation of a tone. The programming of the microprocessor to achieve the desired operation and to provide information on the use of the system is within the scope of one of ordinary skill in the art.

While the invention has been described and illustrated in detail, it is to be clearly understood that this is intended by way of example only and is not to be taken by way of limitation, the scope of the invention being limited only by the terms of the following claims.

We claim:

1. In an electronically controlled security container for a door key, a device for retaining said door key in said container and releasing said door key from said container in response to an externally generated control signal comprising:

means external of said container for generating said control signal, a tray having a latch thereon, said key being placed in said tray, a fork member pivotally mounted in said container, a tapered wheel having gear teeth thereon, motor means for driving said tapered wheel, a cam attached to said fork member, said cam engaging the gear teeth of said wheel and thereby retaining said fork member in engagement with said key tray latch, spring means for urging said fork member in a direction away from said key tray latch for disengagement therefrom, and means responsive to said control signal for causing said motor means to rotatably drive said tapered wheel thereby driving said cam along the teeth of said wheel and off the end thereof such that said spring means drives said fork member out of engagement with said tray latch to release the tray from the container.

2. The device of claim 1 wherein said motor means comprises an electric motor having a gear train connected to the drive shaft thereof, said gear train engaging said tapered wheel.

3. The device of claim 1 and further including spring means for urging said cam in the direction of the taper of said wheel.

4. The device of claim 1 wherein said container has an elastomeric cover.

5. The device of claim 1 wherein said means for generating a control signal comprises a hand held access control unit programmed to generate said signal in response to the manual actuation of a key pad.

6. The device of claim 5 wherein said key pad has buttons for effecting release of said key tray and for entering the user's identification number.

7. The device of claim 1 and further including a shackle removably attached to said container, said shackle having an arm with a notched portion, a second tapered wheel having teeth thereon and a second fork member, said second fork member being pivotally mounted in said container with a cam attached thereto which engages the teeth of said second wheel in the same manner as the cam of the first fork member, said second fork member engaging the notched portion of the shackle arm, and means for generating a control signal for causing said motor means to drive said second tapered wheel until the cam of said second fork member is driven off the end of said wheel such that said second fork member is driven out of engagement with the notched portion of the shackle arm thereby releasing the shackle from the container.

8. The device of claim 7 wherein said motor means comprises a motor having a geared drive shaft, a shuttle gear coupled to said drive shaft, said shuttle gear engaging and driving the first mentioned tapered wheel when said motor drive shaft is driven in a first direction and engaging and driving the second tapered wheel when the motor drive shaft is driven in a direction opposite to said first direction.

9. The device of claim 1 wherein the control signal is a coded infrared signal.

* * * * *